US006530746B2

(12) United States Patent
Huang et al.

(10) Patent No.: US 6,530,746 B2
(45) Date of Patent: Mar. 11, 2003

(54) FAN ASSEMBLY

(75) Inventors: Wen-Shi Huang, Taoyuan Hsien (TW); Kuo-Cheng Lin, Taoyuan (TW); Wei-Chen Kuo, Sanchung (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 09/797,749

(22) Filed: Mar. 1, 2001

(65) Prior Publication Data

US 2001/0028841 A1 Oct. 11, 2001

(30) Foreign Application Priority Data

Apr. 10, 2000 (TW) ..... 89205726 U

(51) Int. Cl.[7] ..... F01D 25/26
(52) U.S. Cl. ..... 415/213.1; 416/244 R
(58) Field of Search ..... 415/53.1, 213.1, 415/220, 224, 203, 206, 199.1; 416/244 R, 198 R

(56) References Cited

U.S. PATENT DOCUMENTS 5,658,130 A * 8/1997 Goldstein et al. ..... 416/100
5,788,568 A * 8/1998 Ito et al. ..... 454/188
6,340,283 B1 * 1/2002 Hedger et al. ..... 415/60

* cited by examiner

*Primary Examiner*—Edward K. Look
*Assistant Examiner*—James M McAleenan

(57) ABSTRACT

A fan assembly includes a first fan device having an engaging medium, and a second fan device having a corresponding engaging medium for engaging with the engaging medium of the first fan device, thereby allowing the second fan device to be combined with the first fan device. The fan device includes a fan frame having the engaging medium adapted to engage with the corresponding engaging medium of another fan frame of another fan device, and a fan secured in the fan frame.

12 Claims, 10 Drawing Sheets

FAN ASSEMBLY

FIELD OF THE INVENTION

The present invention relates to a fan, and more particularly to a fan assembly.

BACKGROUND OF THE INVENTION

The basic function of the industrial fan is ventilating and cooling the electrical apparatus. It normally needs one fan to be mounted in any one of most of electrical apparatuses. The conventional cooling fan we use has generally a square and flat shape, and normally has a generally square fan frame. However, some electrical apparatuses such as the router or the hub have a specific overall shape longer, wider or narrower than that of the usual ones. For a relatively bulky electrical apparatus, it will merely perform the cooling and ventilating function in the local area if we only mount one fan in the electrical apparatus. Thus, it needs to mount multiple fans in the wide side of the electrical apparatus, or else it does not reach the purpose of soundly ventilating and cooling.

FIG. 1 is a schematic view showing an architecture of the conventional multiple fans assembly. Three fan devices 11, 12, 13 respectively are independent fan device units, and respectively have fan frames 112, 122, 132 and pairs of power lines 111, 121, 131. In addition, each fan has four screw holes 14 on the respective fan frame for allowing the corresponding screws to be fixed tightly onto the electrical apparatus.

Presently, the assembling method of the ventilating and cooling fan devices on the electrical apparatus is to fix the multiple conventional fan frames one by one to the electrical apparatus by means of screws one by one. It has a less elasticity of assembly. Moreover, it uses lots of screws for fixing onto the electrical apparatus the multiple conventional fan frames hence it costs much unnecessary manufacturing cost and assembling time. In addition, each fan frame has an external pair of power lines. While multiple fan frames are to be mounted in the electrical apparatus, there are many external pairs of power lines in the electrical apparatus. As known, it is a trouble to arrange these external power lines and handle the entwining external power lines in the electrical apparatus.

It is therefore tried by the applicant to deal with the above situation encountered by the prior art.

SUMMARY OF THE INVENTION

It is therefore an object of the present invention to provide an architecture for a fan assembly, in which the hardware assembling cost and time are reduced because of using fewer screws and using an engaging assembling method.

It is further an object of the present invention to provide an architecture for a fan assembly having a flexible assembling form.

It is still an object of the present invention to provide an assembling method for simplifying the power lines collection of multiple fan devices.

It is additional an object of the present invention to provide an architecture for a fan assembly having a fancy assembling type of multiple fan devices.

It is more an object of the present invention to provide an architecture for a fan assembly, in which a specific fan device unit can be replaced when the specific fan device unit is broken. According to the present invention, a fan assembly includes a first fan device having an engaging medium, and a second fan device having a corresponding engaging medium for engaging with the engaging medium of the first fan device, thereby allowing the second fan device to be combined with the first fan device.

Certainly, the first fan device can further include a additional engaging medium for engaging with a corresponding engaging medium of a third fan device, thereby allowing the third fan device to be combined with the first fan device.

Certainly, the second fan device can further include an additional engaging medium for engaging with a corresponding engaging medium of a fourth fan device, thereby allowing the fourth fan device to be combined with the second fan device.

Certainly, each of the first fan device, the second fan device, the third fan device and the fourth fan device can be one selected from a group consisting of a centrifugal fan, an axial-flow fan and a cross fan.

Preferably the engaging medium of the first fan device is a protruding piece.

Preferably the corresponding engaging medium of the second fan device is a receptacle.

Generally, the present invention further includes plural fan devices to be combined with the first fan device and the second fan device in parallel.

Generally, the present invention further includes plural fan devices to be combined with the first fan device and the second fan device vertically in parallel.

According to a further aspect of the present invention, a fan device includes a fan frame having an engaging medium adapted to engage with a corresponding engaging medium of another the fan frame of another the fan device, and a fan secured in the fan frame.

Certainly, the fan device can be one selected from a group consisting of a centrifugal fan, an axial-flow fan and a cross fan.

Preferably the engaging medium is a protruding piece.

Preferably the corresponding engaging medium is a receptacle.

Certainly, the fan frame can further include another respective engaging medium adapted to engage with a corresponding engaging medium of another fan frame of another the respective fan device.

According to more an aspect of the present invention, a fan assembly includes plural fan devices, each of which has a fan frame having an engaging medium adapted to engage with a corresponding engaging medium of another the fan frame of another the fan device; and a fan secured in the fan frame.

Preferably the engaging medium is a protruding piece.

Preferably the corresponding engaging medium is a receptacle.

Preferably the fan device further includes another engaging medium adapted to engage with a corresponding engaging medium of another fan device of another the respective fan device.

The present invention may best be understood through the following descriptions with reference to the accompanying drawings, in which:

DETAILED DESCRIPTION OF THE PREFERRED EMBODIMENTS

The present invention will now be described more detailedly with reference to the following embodiment. It is to be noted that the following descriptions of the preferred embodiments of this invention are presented herein for the purpose of illustration and description only. It is not intended to be exhaustive or to be limited to the precise from disclosed.

Figure 1:
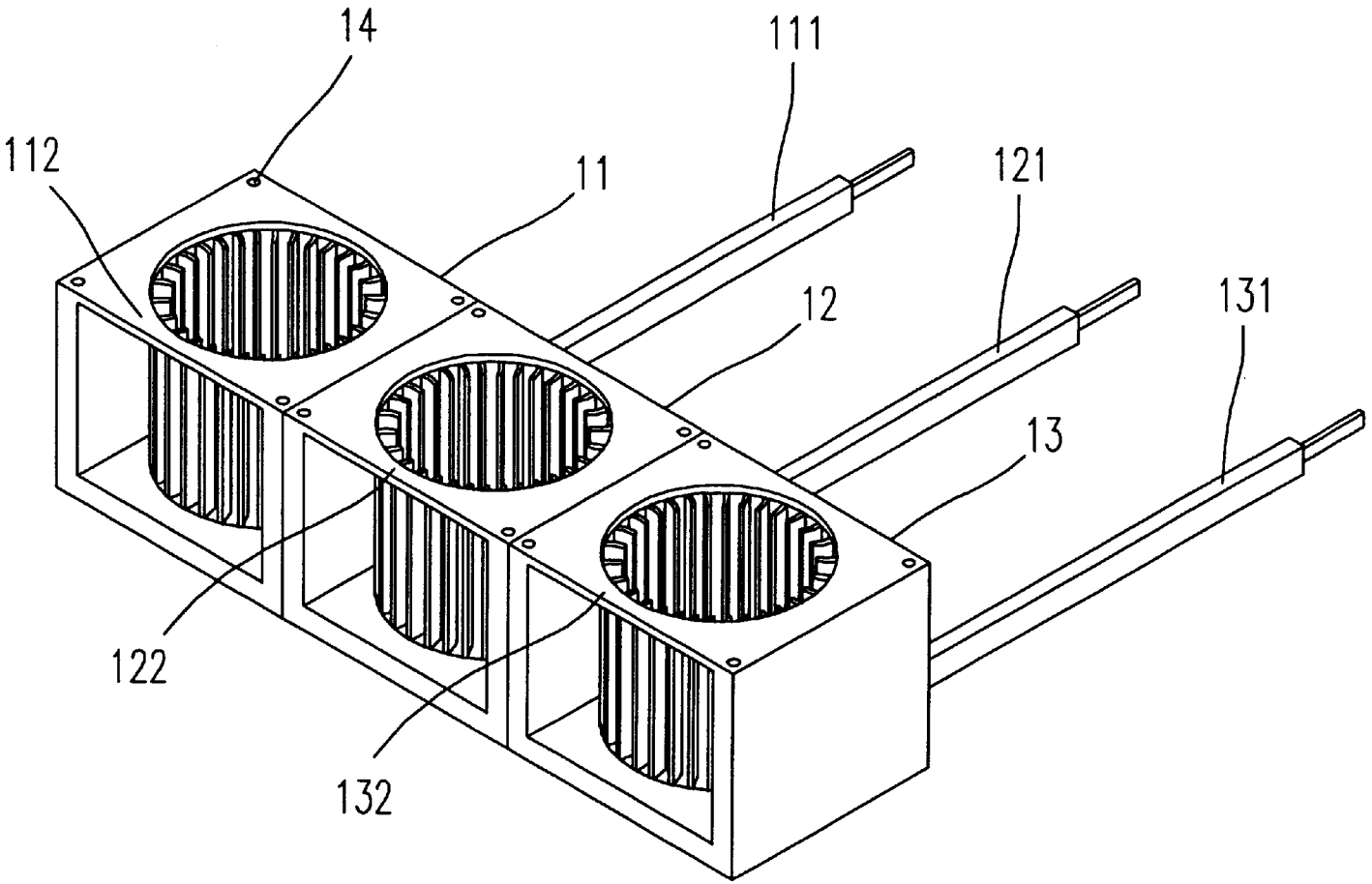
Fig. 1(PRIOR ART)
FIG. 1 is a schematic view showing an architecture of the conventional multiple fans assembly.
Figure 2A:
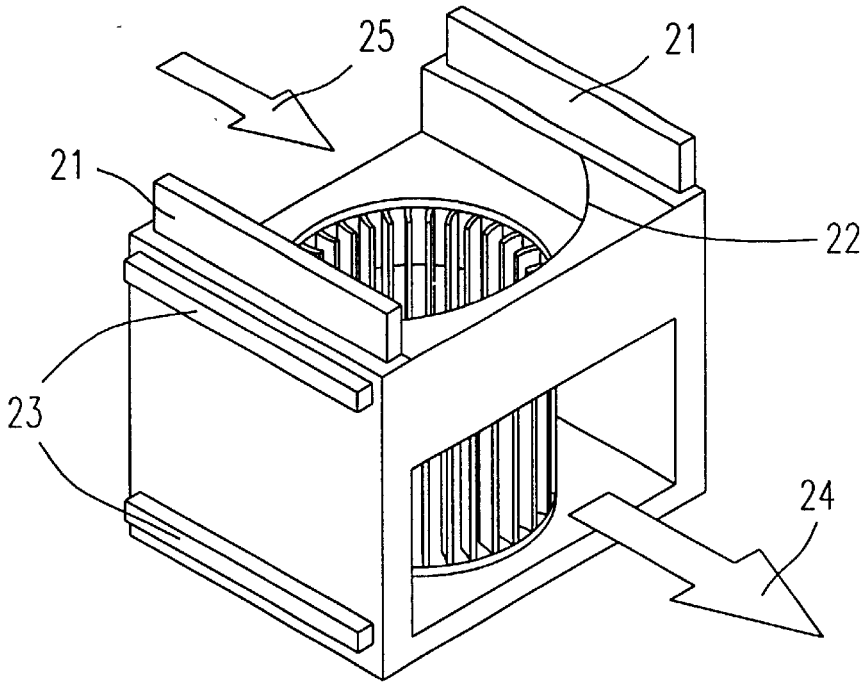
FIGS. 2A and 2B are schematic views showing a preferred embodiment of the architecture for a fan assembly unit in two different states according to the present invention.
Figure 2B:
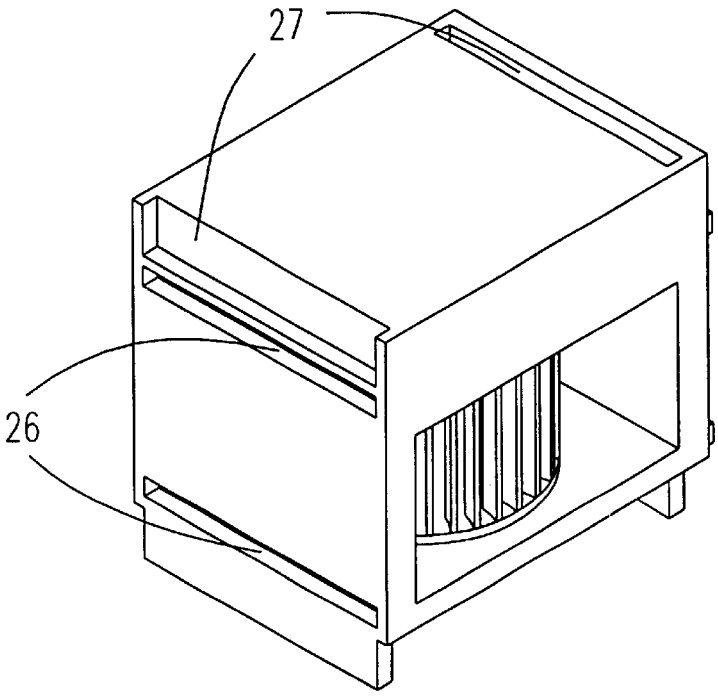

Referring now to FIG. 2A and FIG. 2B, there are shown schematic views showing an architecture of a fan assembly unit according to the present invention, and the illustrations of FIG. 2A and FIG. 2B respectively are differently placed views of the architecture of a fan assembly. In the illustration of FIG. 2A, there are an upper protruding piece 21, an inlet 25, a stream-guiding line 22, left protruding pieces 23 and an outlet 24 according to the present invention. Furthermore, the fan assembly unit further includes right receptacles 26 and a lower receptacle 27 in the upside-down illustration of FIG. 2B according to the present application.

Accordingly, the above-mentioned protruding pieces and receptacles can be used as the engaging media and the corresponding engaging media. These media can be used to assemble together a plurality of the same fan device units in the diversiform fan assembly such as side-by-side, overlapped series or fancy form. In addition, the power lines of the fan device can pass to the next fan device through the protruding pieces and the receptacles in the fan devices. It can minimize the assemblage complexity of the external pairs of power lines. And the outward forms of the protruding pieces and the receptacles in the fan device unit can be redesigned to be adapted to different requirements.

Figure 3A:
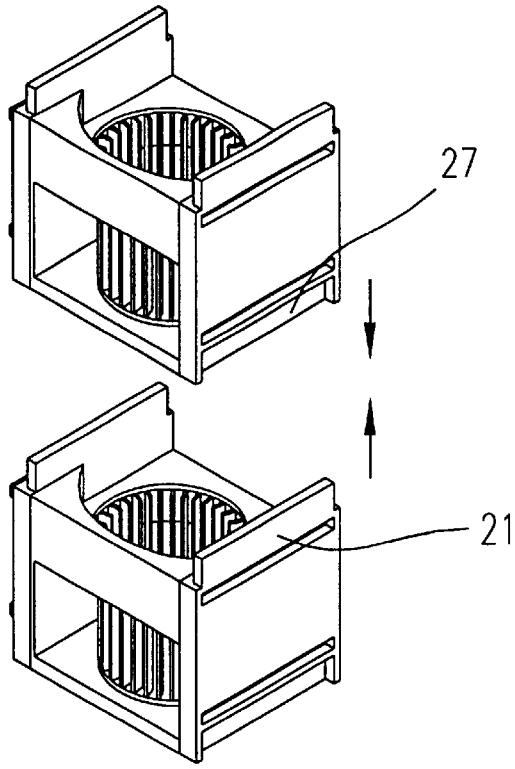
FIGS. 3A and 3B are schematic views respectively showing a further preferred embodiment in the assembling process for a fan assembly before and after a fan device is combined with another one vertically in parallel according to the present invention.
Figure 3B:
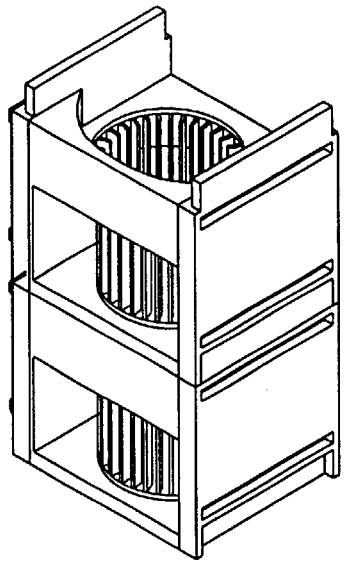

What are shown in the FIGS. 3A and 3B are schematic views showing in the assembling process an architecture for a fan assembly before and after a fan device is combined with another one vertically in parallel. Referring now to FIG. 3A, the lower receptacles 27 in the upper fan device can be engaged with the upper protruding pieces 21 in the lower fan device to form the combined form of two fan devices overlapping as shown in FIG. 3B.

Figure 4A:
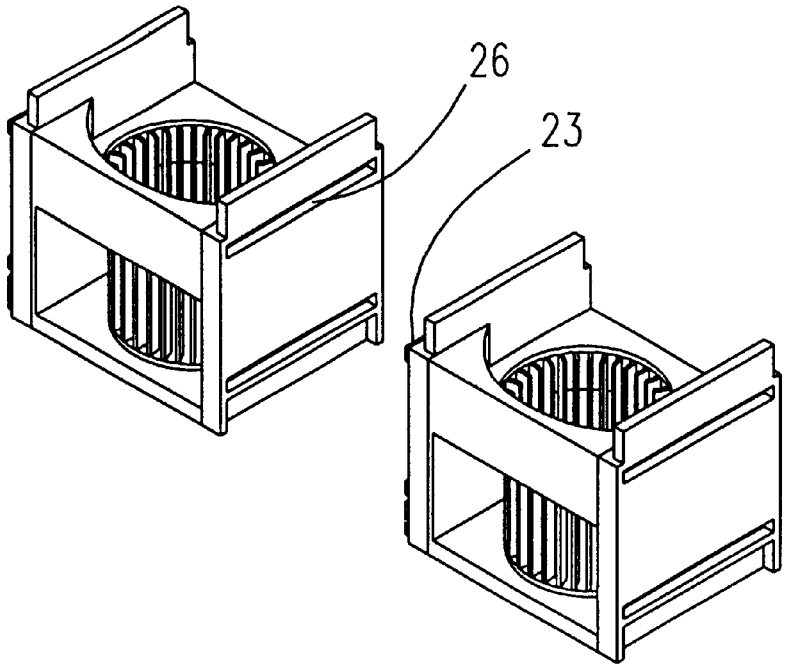
FIGS. 4A and 4B are schematic view respectively showing a yet preferred embodiment in the assembling process for a fan assembly before and after a fan device is combined with another one in parallel according to the present invention.
Figure 4B:
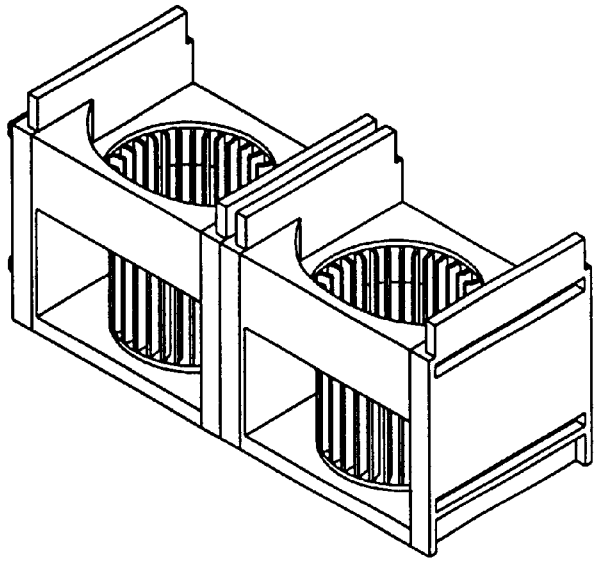

FIG. 4A and FIG. 4B are schematic views showing the states before and after a fan device is combined with another one in parallel. Referring now to FIG. 4A, the left protruding pieces 23 in the right fan device can be engaged with the right receptacles 26 in the left fan device to form the combined form of two fan devices side by side as shown in FIG. 4B.

Figure 5:
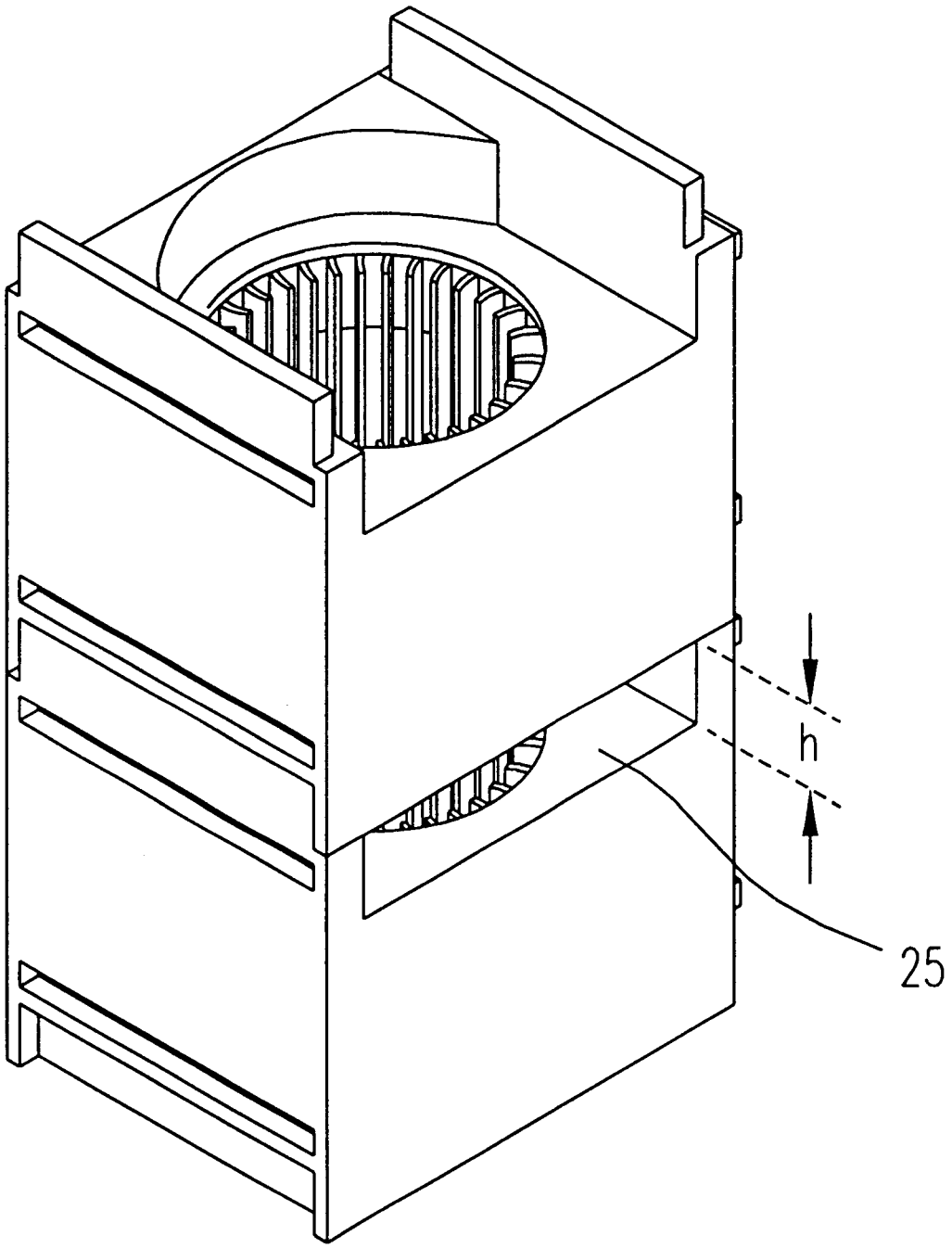
FIG. 5 is a schematic view showing an outlet architecture for a fan assembly of FIG. 3 according to the present invention.

Referring to FIG. 5, there is shown a schematic view of an outlet of the fan assembly in FIG. 3B according to the present application. While the duplicate fan devices are overlapping, there is the outlet 25 having a height h between the fan devices. Therefore, this combining method will not interfere the performance of the ventilating and cooling function.

Figure 6:
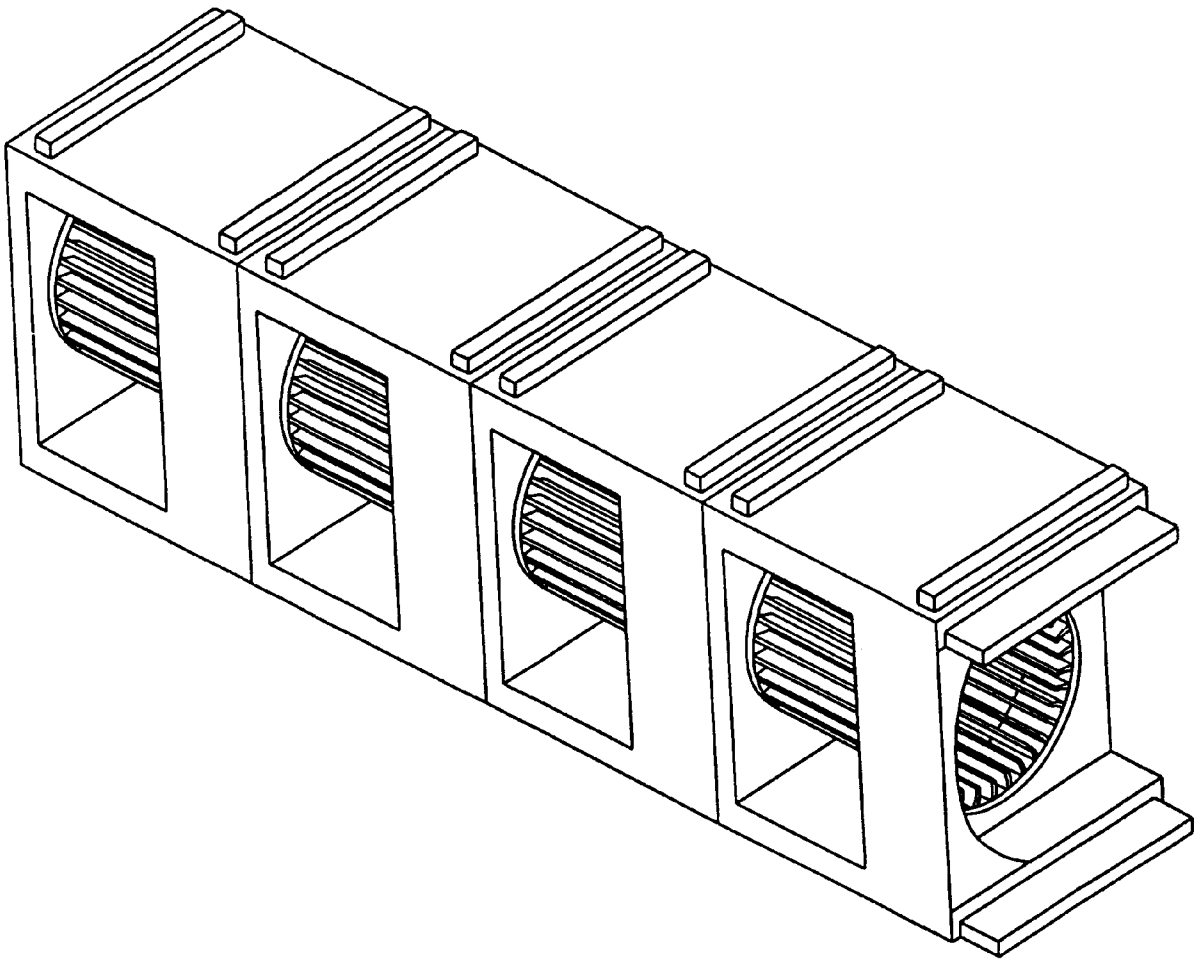
FIG. 6 is a schematic view showing more a preferred embodiment architecture for a fan assembly of multiple fan devices being combined to each other vertically in parallel according to the present invention.
Figure 7:
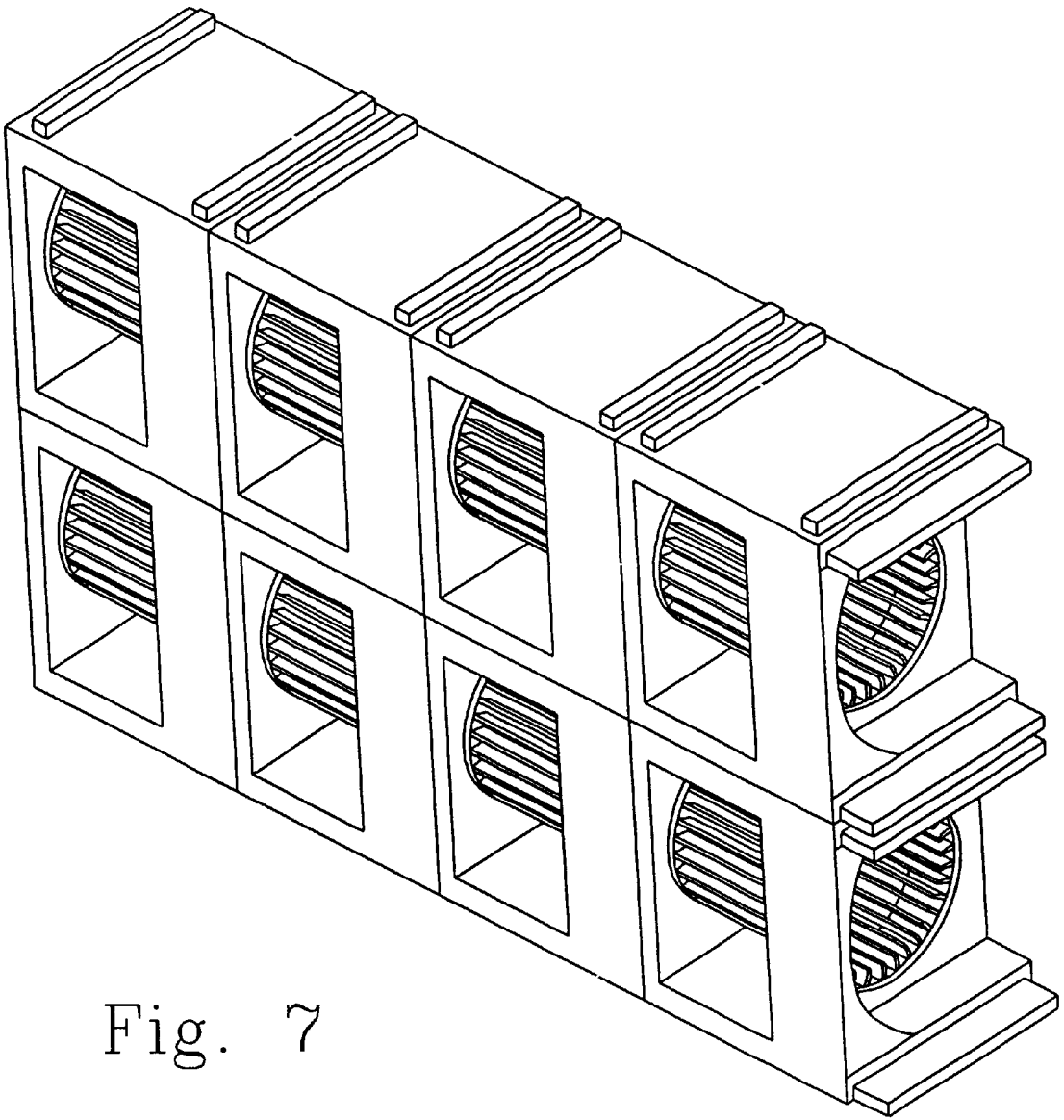
FIG. 7 is a schematic view showing an additional preferred embodiment architecture for a fan assembly of multiple tiers of multiple fan devices being assembled to each other vertically in parallel according to the present invention.
Figure 8:
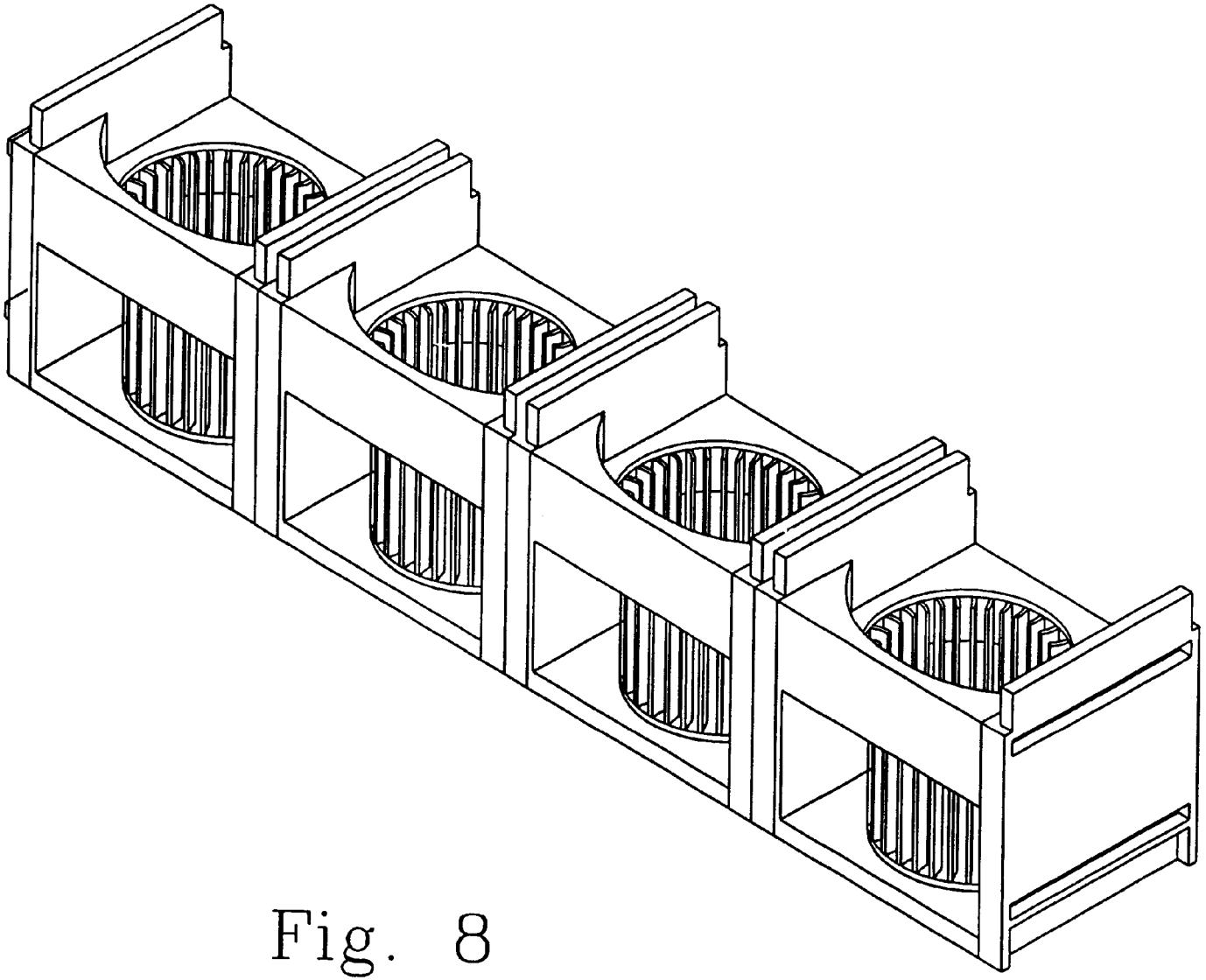
FIG. 8 is a schematic view showing a further preferred embodiment architecture for a fan assembly being combined to each other in parallel according to the present invention.
Figure 9:
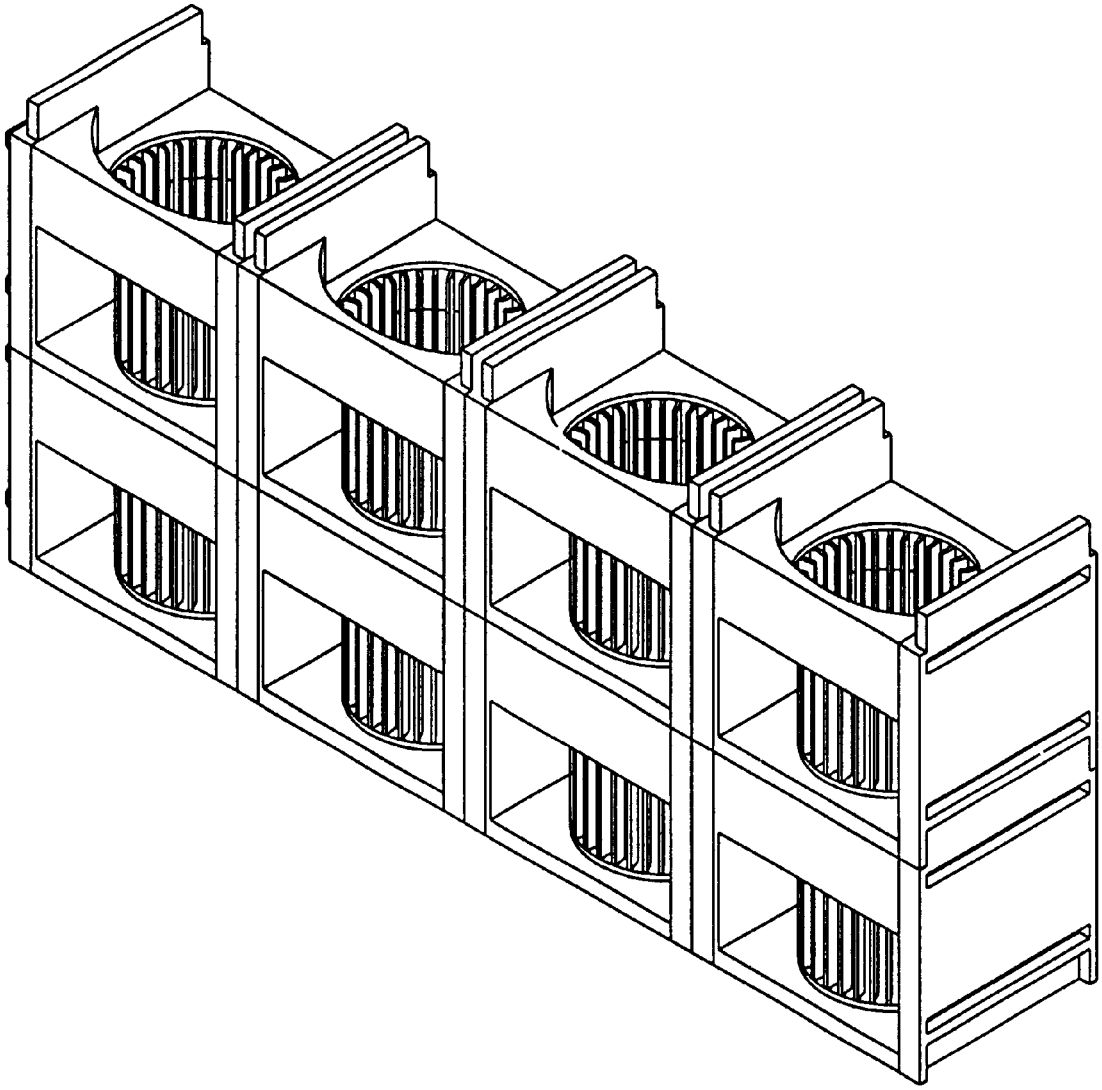
FIG. 9 is a schematic view showing a preferred embodiment architecture for a fan assembly of multiple tiers of multiple fan devices being combined to each other in parallel according to the present invention.
Figure 10:
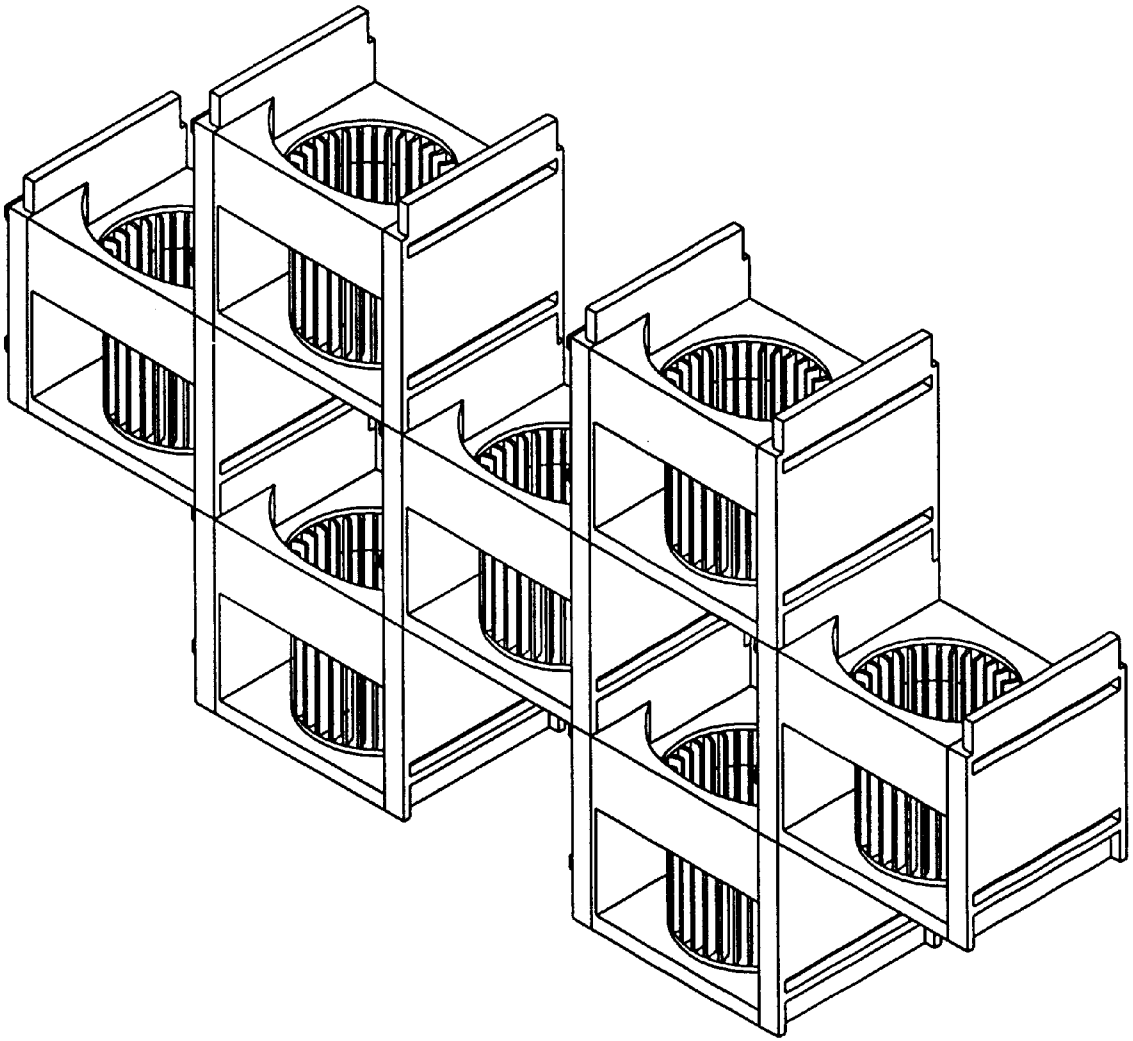
FIG. 10 is a schematic view showing more a preferred embodiment architecture for a fan assembly of a fancy assembling form according to the present invention.

FIG. 6 shows an assembly of four fan devices, wherein each fan is connected to one another vertically in parallel. FIG. 7 shows the combination of two tiers of assembly shown in FIG. 6. FIG. 8 shows another assembly of four fan devices, wherein each fan device is connected to one another horizontally in parallel. As to FIG. 9, it is the combination of two tiers of assembly shown in FIG. 8. Finally, FIG. 10 shows a fancy assembly of multiple fan devices, wherein each fan device is connected to one another at random for some purposes. In the instances described above, the fan devices are centrifugal fans. Certainly, the fan devices can also be axial-flow fans or cross fans. Furthermore, each fan device can be connected to one another on all sides.

In a nutshell, the present invention has a plurality of fan devices whose fan frames include an engaging medium adapted to engage with a corresponding engaging medium of another said fan frame of another said fan device. And the fan frame further includes another engaging medium adapted to engage with the corresponding engaging medium of another fan device of another said respective fan device. They can be combined to a random type design. The engaging medium can be a protruding piece, and the corresponding engaging medium can be a receptacle.

In conclusion, the present invention discloses an improved fan assembly which is capable of providing a flexible assembly and can use fewer screws for fixing and assembling, so that it is no more like the inflexible and inconvenient conventional assembling form and can thus minimize the fan manufacturing cost and the assembling time. For this reason, the fan assembly has a convenient maintaining predominance because we only require a new fan device unit to replace with the specific broken one when one fan device of the fan assembly is broken. Moreover, the present application also provides an improved assembling method for the multiple pairs of power lines from a fan assembly formed by multiple fan devices. The pairs of power lines of a fan device can pass to the next fan device through the protruding pieces and the receptacles in the fan devices, so as to sort the multiple power lines, minimize the assemblage complexity and avoid the entwining problem of the external pairs of power lines.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What we claimed is:

1. A fan assembly, comprising a first fan device having an engaging medium; and a second fan device having a corresponding engaging medium for engaging with said engaging medium of said first fan device, thereby allowing said second fan device to be combined with said first fan device, wherein said engaging medium of said first fan device is a protruding piece, and said corresponding engaging medium of said second fan device is a receptacle.

2. The fan assembly according to claim 1, wherein said first fan device further comprises an additional engaging medium for engaging with a corresponding engaging medium of a third fan device, thereby allowing said third fan device to be combined with said first fan device.

3. The fan assembly according to claim 2, wherein said second fan device further comprises an additional engaging medium for engaging with a corresponding engaging medium of a fourth fan device, thereby allowing said fourth fan device to be combined with said second fan device.

4. The fan assembly according to claim 1, wherein each of said first fan device, said second fan device, said third fan device and said fourth fan device is one selected from a group consisting of a centrifugal fan, an axial-flow fan and a cross fan.

5. The fan assembly according to claim 1, further comprising plural fan devices to be combined with said first fan device and second fan device in parallel.

6. The fan assembly according to claim 1, further comprising plural fan devices to be combined with said first fan device and second fan device vertically in parallel.

7. A first fan device, comprising:

a fan frame having a first engaging medium adapted to engage with a corresponding engaging medium of a second fan device; and a fan secured in said fan frame, wherein said first engaging medium is a protruding piece, and said corresponding engaging medium is a receptacle.

8. The fan device according to claim 7, wherein said fan device is one selected from a group consisting of a centrifugal fan, an axial-flow fan and a cross fan.

9. The first fan device according to claim 7, wherein said fan frame further comprises a second engaging medium adapted to engage with a corresponding engaging medium of a third fan device.

10. A fan assembly, comprising:

plural fan devices, each of which comprises:

a fan frame having a first engaging medium adapted to engage with a corresponding engaging medium of a first adjacent fan device of the plural fan devices; and a fan secured in said fan frame;

wherein said first engaging medium is a protruding piece, and said corresponding engaging medium is a receptacle.

11. The fan assembly according to claim 10, wherein each of the plural fan devices further comprises a second engaging medium adapted to engage with a corresponding engaging medium of a second adjacent fan device of the plural fan devices.

12. The fan assembly according to claim 10, wherein each of said plural fan devices is one selected from a group consisting of a centrifugal fan, an axial-flow fan and a cross fan.

* * * * *